US008007328B2

(12) United States Patent
Williams

(10) Patent No.: US 8,007,328 B2
(45) **Date of Patent: *Aug. 30, 2011**

(54) SELF-CONTAINED HYDRAULIC THRUSTER FOR VESSEL

(76) Inventor: John T. Williams, Deland, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/976,246

(22) Filed: Dec. 22, 2010

(65) Prior Publication Data

US 2011/0081811 A1 Apr. 7, 2011

Related U.S. Application Data

(63) Continuation-in-part of application No. 12/924,356, filed on Sep. 24, 2010, which is a continuation-in-part of application No. 12/806,274, filed on Aug. 9, 2010, which is a continuation-in-part of application No. 12/800,026, filed on May 6, 2010, which is a continuation-in-part of application No. 12/381,245, filed on Mar. 10, 2009, now Pat. No. 7,883,384, which is a continuation-in-part of application No. 11/999,531, filed on Dec. 6, 2007, now Pat. No. 7,654,875.

(60) Provisional application No. 60/903,400, filed on Feb. 26, 2007.

(51) Int. Cl.
*B63H 21/12* (2006.01)

(52) U.S. Cl. ..... 440/5; 114/151

(58) Field of Classification Search ..... 114/150, 114/151; 440/5, 6, 61 A, 61 R
See application file for complete search history.

(56) References Cited

U.S. PATENT DOCUMENTS

| | | | |
|---|---|---|---|
| 2,936,730 | A | 5/1960 | Patty, Jr. |
| 4,878,864 | A | 11/1989 | Van Bentem |
| 6,332,817 | B1 | 12/2001 | Nakamura |
| 6,799,528 | B1 | 10/2004 | Bekker |
| 7,654,875 | B1 | 2/2010 | Williams |

OTHER PUBLICATIONS

U.S. Appl. No. 12/924,356, filed Sep. 24, 2010, Williams, John.
U.S. Appl. No. 12/806,274, filed Aug. 9, 2010, Williams, John.
U.S. Appl. No. 12/800,026, filed May 6, 2010, Williams, John.
U.S. Appl. No. 12/381,245, filed Mar. 10, 2009, Williams, John.
Photographs of Harbor Master System 1946.
Photographs of Shugart System 1962.
Photographs of Poseidon Barge Pusher 2010.

*Primary Examiner* — Lars A Olson
(74) *Attorney, Agent, or Firm* — Paul S. Rooy, PA

(57) ABSTRACT

A self-contained hydraulic thruster for vessel. A power pack is mounted on a forward end of a base, and a helm platform is mounted on an aft end of the base at a substantial height above the base. A reservoir in communication with the power pack is mounted on the helm platform, thus facilitating hydraulic fluid flow from the reservoir to the power pack, and also rendering the hydraulic system self-priming. At least one lower unit is tiltably mounted to the base aft end, laterally offset from the helm platform. Due to the lateral offset between the lower unit(s) and the helm platform, interference between the lower unit(s) and the helm platform is avoided when the lower unit(s) is retracted and tilted up for transportation, storage, or maintenance.

14 Claims, 10 Drawing Sheets

SELF-CONTAINED HYDRAULIC THRUSTER FOR VESSEL

CLAIM FOR PRIORITY

This utility patent application is a Continuation-In-Part U.S. utility patent application of Ser. No. 12/924,356 filed Sep. 24, 2010 entitled Self-Contained Hydraulic Thruster for Vessel which is a Continuation-In-Part of U.S. utility patent application Ser. No. 12/806,274 filed Aug. 9, 2010 entitled Hydraulic Thruster for Vessel, which is a Continuation-In-Part of U.S. utility patent application Ser. No. 12/800,026 filed May 6, 2010 entitled Modular Hydraulic Thruster System for Vessel, which is a Continuation-In-Part of U.S. utility patent application Ser. No. 12/381,245 filed Mar. 10, 2009 now U.S. Pat. No. 7,883,384 entitled Self-Contained Hydraulic Thruster for Vessel, which is a Continuation-In-Part of U.S. utility patent application Ser. No. 11/999,531 filed Dec. 6, 2007 which issued as U.S. Pat. No. 7,654,875 on Feb. 2, 2010 entitled Self-Contained Hydraulic Thruster for Vessel, which was based upon U.S. provisional patent application Ser. No. 60/903,400 filed Feb. 26, 2007 entitled Self-Contained Hydraulic Thruster for Vessel; and claims the benefit of the earlier filing date of these applications.

BACKGROUND OF THE INVENTION

1. Field of the Invention

This invention relates to vessel propulsion systems, and in particular to a self-contained hydraulic thruster for vessel.

2. Background of the Invention

Marine thrusters typically mount on barges and flat boats, and are used as propulsion for these vessels. One type of marine thruster employs a prime mover such as a diesel engine driving a hydraulic pump, together known as a "power pack", and the resultant pressurized hydraulic fluid may be employed to drive a propeller attached to a lower unit.

There are a number of problems associated with currently available marine thrusters. Where a centrally located tiltable lower unit has been retracted and tilted backwards for transportation, storage, maintenance, cleaning, etc., the protruding upper end of the lower unit interferes with the helm and helm platform, and prevents full upward tilting of the retracted lower unit. Therefore, it would be desirable to provide a marine thruster which may be retracted and then fully tilted.

Another problem with existing designs: the hydraulic fluid reservoir is disposed on the base of the marine thruster, where it is incapable of supplying enough fluid head to self-prime the power pack, and to facilitate hydraulic fluid flow to the hydraulic power pack. Thus, it would be desirable to provide a hydraulic fluid reservoir which is elevated to a substantial height above the level of the base upon which the power pack is mounted.

Still another problem is where a marine thruster's single lower unit propeller does not supply enough power to adequately propel a vessel upon which it is mounted. It would therefore be desirable to provide a marine thruster with more than one lower unit, for increased power.

Existing Designs

FIGS. 1 and 2 are illustrative of the tilt interference problem, and are rear views of a prior art marine thruster 2. The location of their lower units 4 directly behind their respective helms 6 causes interference between lower unit 4 and helm 6 when attempting to fully tilt lower unit 4 up when lower unit 4 is fully retracted. This interference prevents lower unit 4 from fully tilting up when it is fully retracted, thus hindering stowing of lower unit 4 for storage, transportation, servicing, cleaning, etc.

In addition, the mounting of the hydraulic fluid reservoir on the base of this design provides inadequate flow from the hydraulic fluid tank for self-priming and gravitational flow from the hydraulic fluid tank to the power pack.

SUMMARY OF THE INVENTION

It is an object of the present invention to provide a self-contained hydraulic thruster for vessel with an elevated hydraulic fluid reservoir. Design features allowing this object to be accomplished include a hydraulic fluid reservoir mounted on a helm platform which is elevated a substantial height above a base to which a hydraulic power pack is mounted. Benefits associated with the accomplishment of this object include power pack self-priming, and facilitated hydraulic fluid flow from the hydraulic fluid reservoir to the hydraulic power pack.

It is another object of the present invention to provide a self-contained hydraulic thruster for vessel whose lower unit(s) may be retracted and tilted up without interference from the helm platform. Design features allowing this object to be accomplished include at least one lower unit mounted at an end of a lower unit mounting member, the lower unit being laterally offset from a steering platform. Advantages associated with the accomplishment of this object include more efficient lower unit stowing for storage and/or transportation, greater tilt achievable (close to 90 degrees), the ability to tilt the propellers and lower unit completely out of the water for servicing and cleaning, decreased corrosion due to the ability to tilt up the lower units and propellers completely out of the water when not in use to reduce corrosion, and greater retraction of the lower unit.

It is yet another object of this invention to provide a self-contained hydraulic thruster for vessel which is economical to build. Design features allowing this object to be achieved include the use of components made of readily available materials, and commercially available components such as an existing hydraulic actuator, hydraulic power pack, hydraulic fluid reservoir, lower unit, propeller, steering gear, drive gear, and hydraulic lines. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Ten sheets of drawings are provided. Sheet one contains FIGS. 1 and 2. Sheet two contains FIG. 3. Sheet three contains FIG. 4. Sheet four contains FIG. 5. Sheet five contains FIG. 6. Sheet six contains FIG. 7. Sheet seven contains FIG. 8. Sheet eight contains FIG. 9. Sheet nine contains FIG. 10. Sheet ten contains FIG. 11.

DETAILED DESCRIPTION OF THE PREFERRED EMBODIMENT

Figure 3:
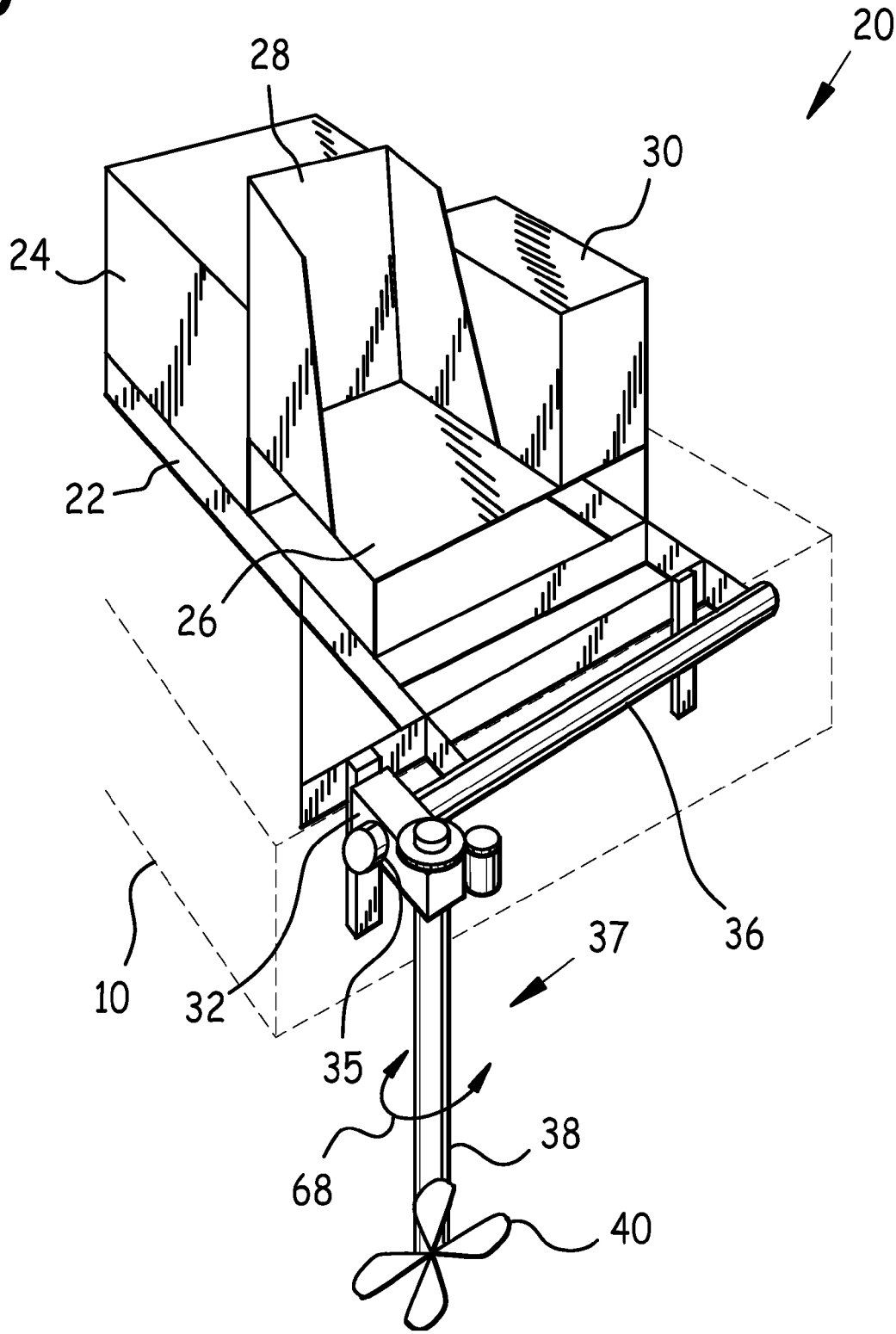
FIG. 3 is a left rear quarter elevated isometric view of a self-contained hydraulic thruster for vessel having a single lower unit offset from the helm platform to permit full retraction and tilting up of the lower unit, with its lower unit in the extended and tilted-down position.
Figure 4:
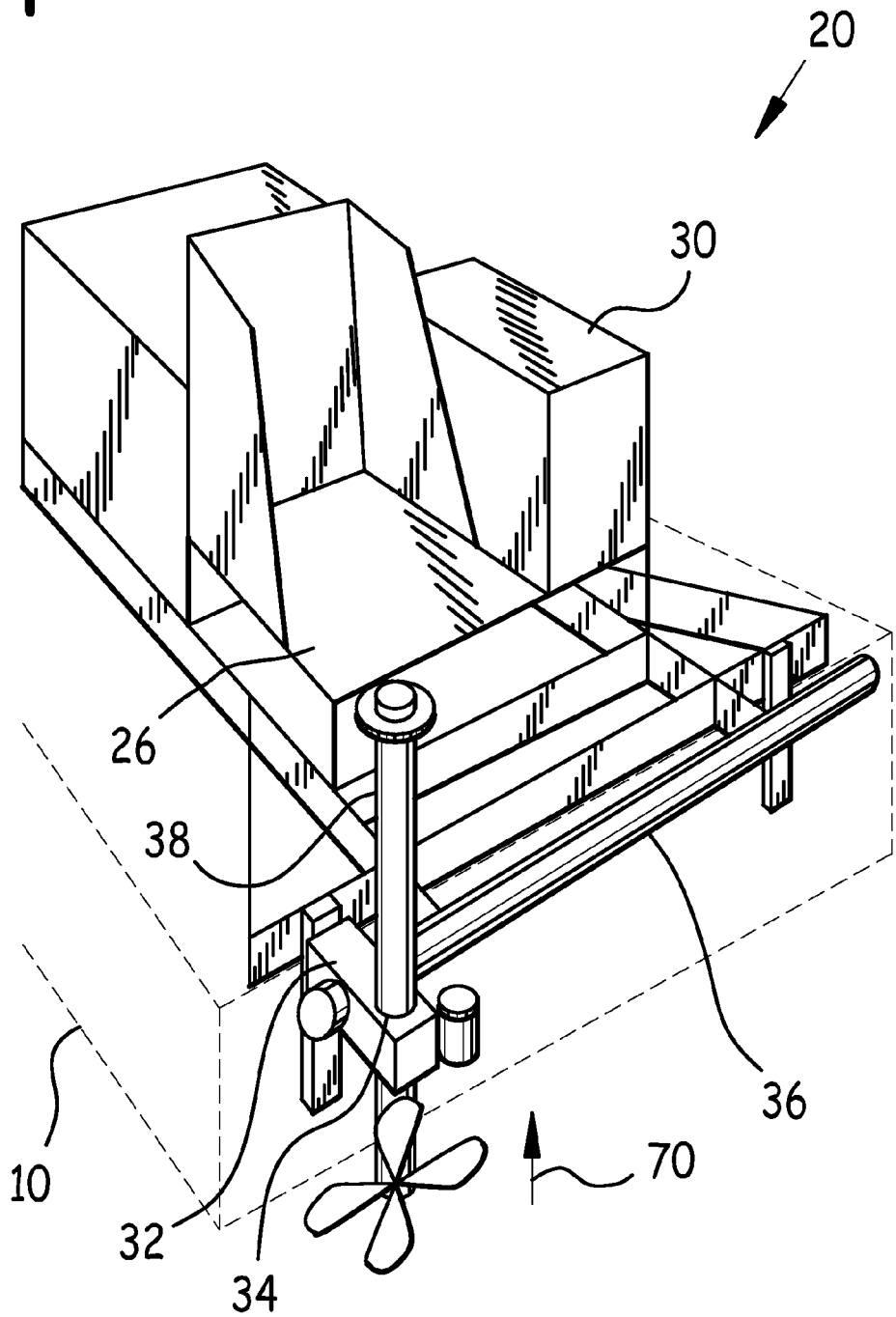
FIG. 4 is a left rear quarter elevated isometric view of a self-contained hydraulic thruster for vessel having a single lower unit offset from the helm platform to permit full retraction and tilting up of the lower unit, with its lower unit in the retracted and tilted-down position.
Figure 5:
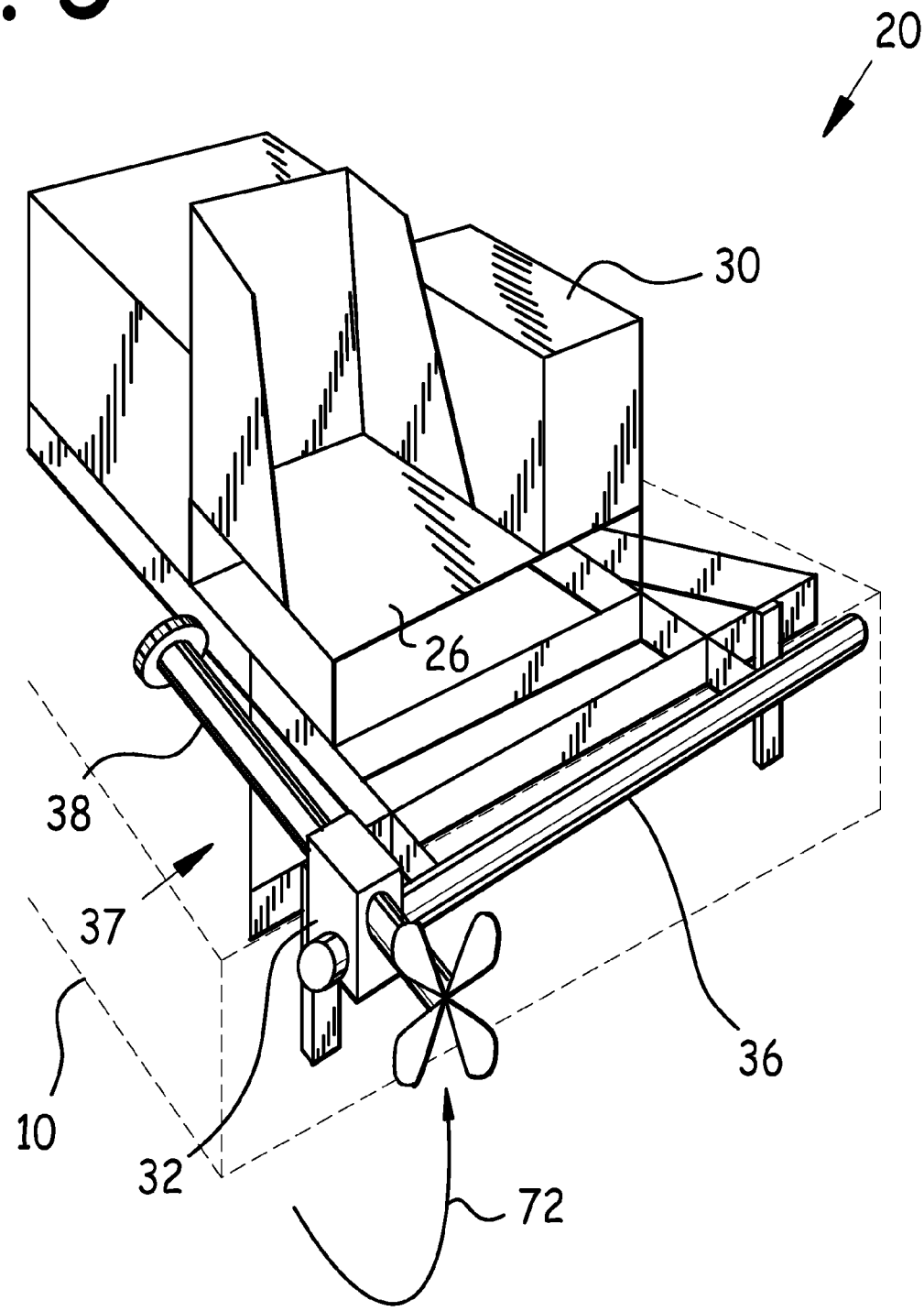
FIG. 5 is a left rear quarter elevated isometric view of a self-contained hydraulic thruster for vessel having a single lower unit offset from the helm platform to permit full retraction and tilting up of the lower unit, with its lower unit in the fully retracted and fully tilted-up position.

FIG. 3 is a rear quarter isometric view of self-contained hydraulic thruster 20 mounted at the stern of a vessel 10, with its lower unit 37 in the extended and tilted-down position. FIG. 4 is a rear quarter isometric view of self-contained hydraulic thruster 20 mounted at the stern of a vessel 10, with its lower unit 37 in the retracted and tilted-down position. FIG. 5 is a rear quarter isometric view of self-contained hydraulic thruster 20 mounted at the stern of a vessel 10, with its lower unit 37 in the retracted and tilted-up position.

As may be observed in these figures, hydraulic thruster 20 comprises power pack 24 mounted to the front (or forward end) of base 22, and helm platform 26 mounted to the rear (or aft end) of base 22. Helm platform 26 is mounted a substantial height above base 22. Helm 28 and hydraulic fluid reservoir 30 are mounted atop helm platform 26.

In this configuration, hydraulic fluid within hydraulic fluid reservoir 30 is urged by gravity to flow to power pack 24, thus improving hydraulic fluid flow from hydraulic fluid reservoir 30 to power pack 24, and rendering power pack 24 self-priming. These are two important advantages to mounting hydraulic fluid reservoir 30 atop helm platform 26, at a substantial height above base 22.

Figure 9:
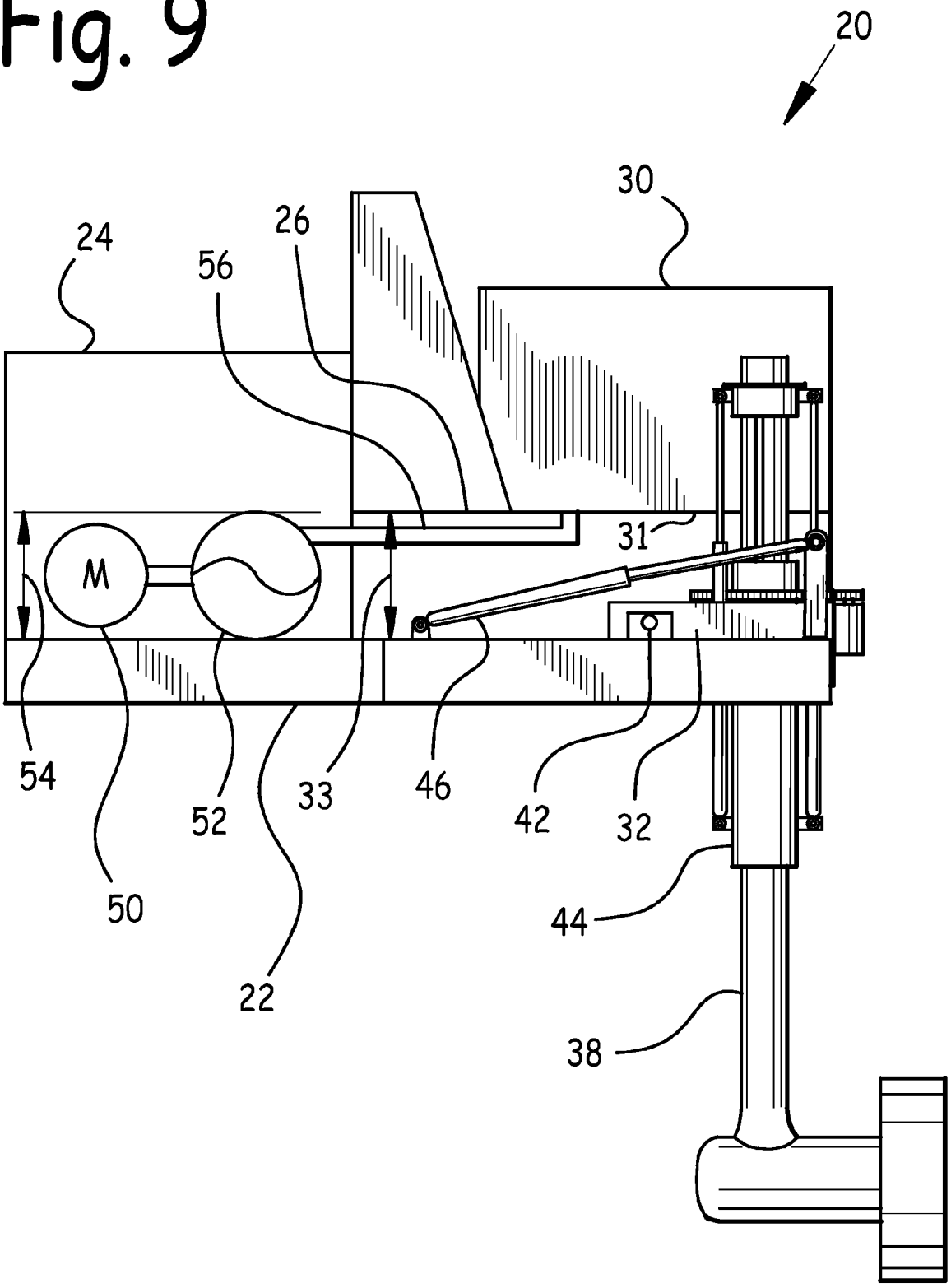
FIG. 9 is side view of an alternate embodiment self-contained hydraulic thruster for vessel, with the lower units in the retracted and tilted-down position, and showing a cross-sectional view of the power pack so that the prime mover driving the hydraulic pump are visible.

FIG. 9 shows hydraulic power pack 24 in cross-section, rendering visible prime mover 50 driving hydraulic pump 52 having hydraulic pump height 54. While FIG. 9 depicts hydraulic pump 52 within power pack 24, it is intended to fall within the scope of this disclosure that hydraulic pump 52 may be disposed anywhere on base 22. Hydraulic fluid reservoir 30 communicates with hydraulic pump 52 via hydraulic line 56. Hydraulic fluid reservoir 30 comprises hydraulic fluid reservoir floor 31 disposed at hydraulic fluid reservoir floor height 33 above base 22.

In the preferred embodiment, hydraulic fluid reservoir floor height 33 was equal to or greater than 75% of hydraulic pump height 54. It was determined experimentally that this minimum hydraulic fluid reservoir floor height 33 is optimum to achieve the afore-mentioned benefits of improving hydraulic fluid flow from hydraulic fluid reservoir 30 to hydraulic pump 52, and rendering hydraulic pump 52 and its associated hydraulic lines self-priming.

Hydraulic thruster 20 further comprises lower unit 37 rotatably, tiltably and retractably attached to the rear of hydraulic thruster 20, laterally offset from helm platform 26.

FIGS. 3-5 depict rear quarter isometric views of a self-contained hydraulic thruster for vessel 20 having a single lower unit 37 offset from helm platform 26 to permit full retraction and tilting up of lower unit 37. In this embodiment, lower unit mounting member 36 is mounted to the rear of base 22.

Lower unit 37 comprises tube 38, housing 32, and propeller 40. Propeller 40 is disposed at a distal end of tube 38, and serves to provide thrust in the water to hydraulic thruster 20. Tube 38 is rotatably and reciprocatingly attached to housing 32, whereby a steering function is provided to tube 38 and propeller 40, as indicated by arrow 68 in FIG. 3, and an extension/retraction function is provided to tube 38 and propeller 40, as indicated by arrow 70 in FIG. 4. In the preferred embodiment, tube 38 was sized to slidably and rotatably fit through housing tube bore 34 in housing 32.

Housing 32 also comprises housing lower unit mounting member bore 35 sized to rotatably admit lower unit mounting member 36. Thus, a tilt function is provided to lower unit 37 by means of the rotatable attachment between housing 32 and lower unit mounting member 36, as indicated by arrow 72 in FIG. 5.

FIG. 3 depicts lower unit 37 tilted fully down, with tube 38 in the fully extended position relative to housing 32. FIG. 4 depicts lower unit 37 tilted fully down, with tube 38 in the fully retracted position relative to housing 32, having been retracted as indicated by arrow 70. FIG. 5 depicts lower unit 37 tilted fully up as indicated by arrow 72, with tube 38 in the fully retracted position relative to housing 32.

Figure 1:
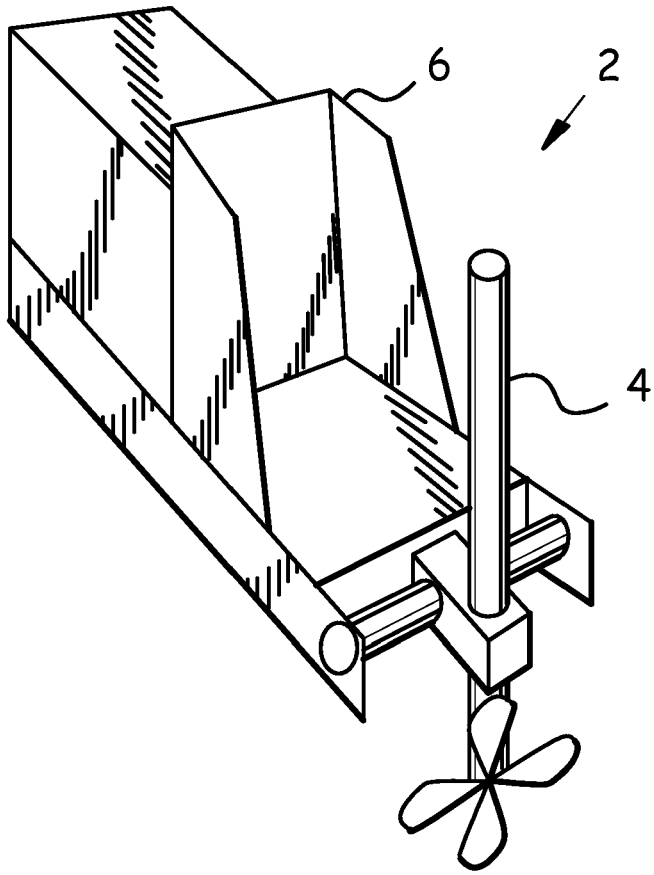
Fig. 1 PRIOR ART
FIGS. 1 and 2 are left rear quarter elevated views of a prior art marine thruster.
Figure 2:
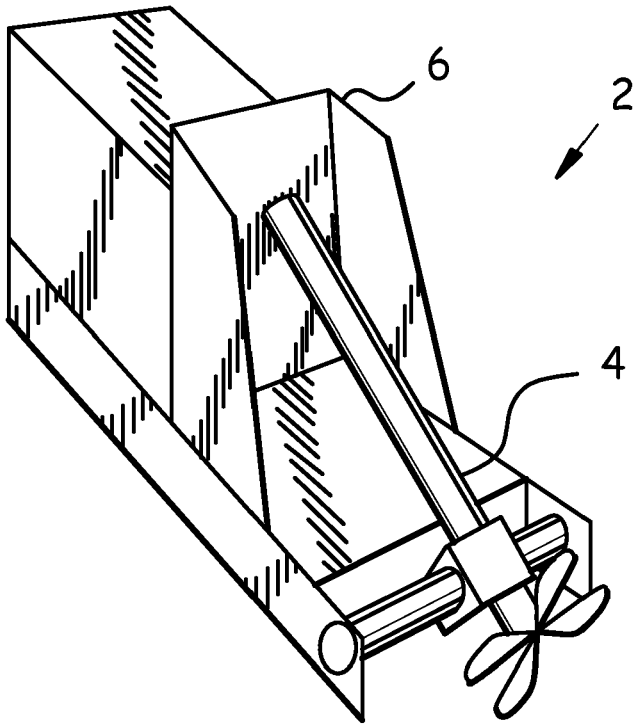
Fig. 2 PRIOR ART

As may be observed in FIG. 5, the instant invention does not suffer from the lower unit/helm platform interference problem which plagues prior art thrusters, when the lower unit is retracted and tilted up. This advantage is made possible by the lateral offset of lower unit 37 relative to helm platform 26, a major advance compared to the prior art configurations depicted in FIGS. 1 and 2.

Figure 6:
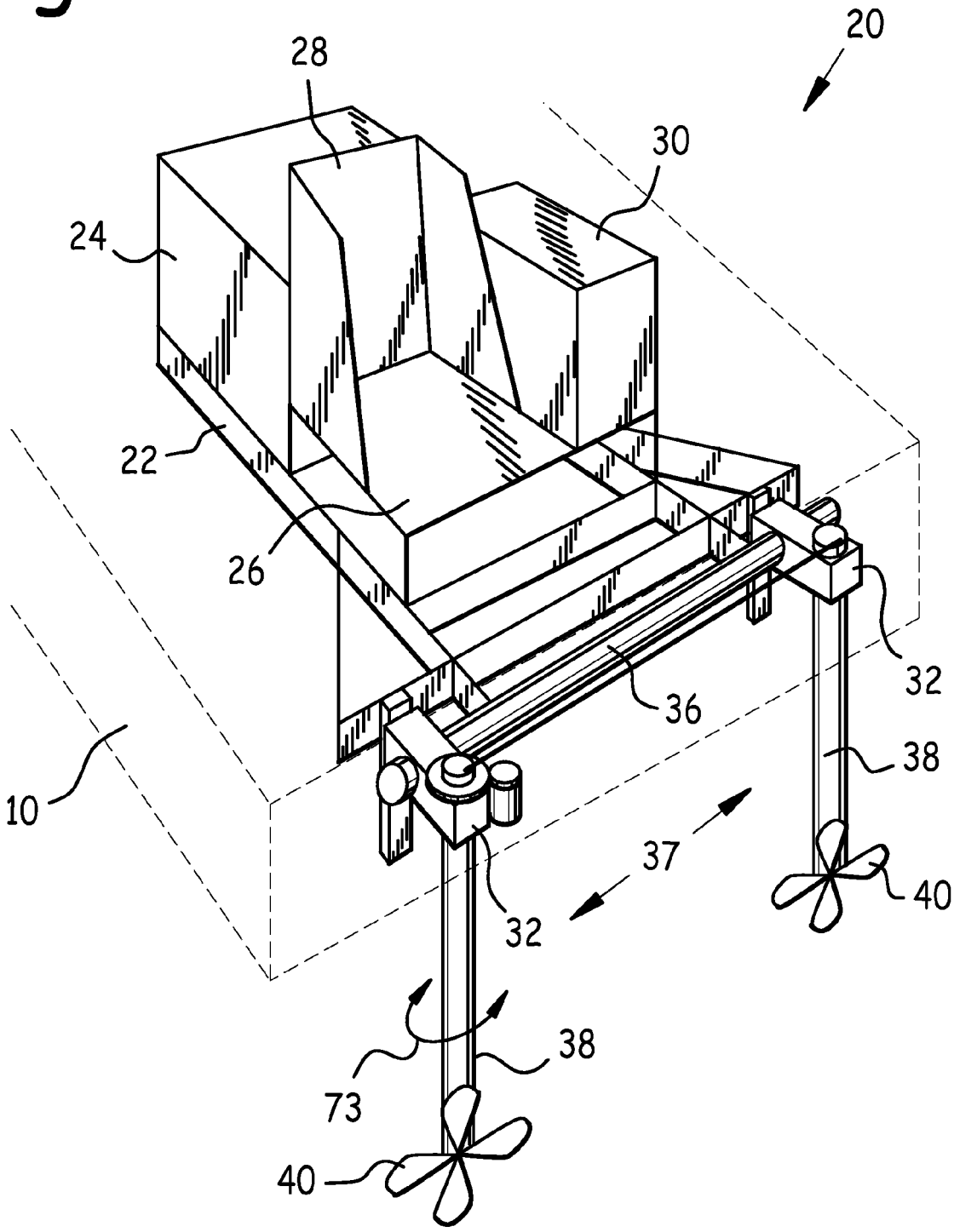
FIG. 6 is a left rear quarter elevated isometric view of an alternate embodiment self-contained hydraulic thruster for vessel having a two lower units offset from the helm platform to permit full retraction and tilting up of the lower units, with the lower units in the extended and tilted-down position.
Figure 7:
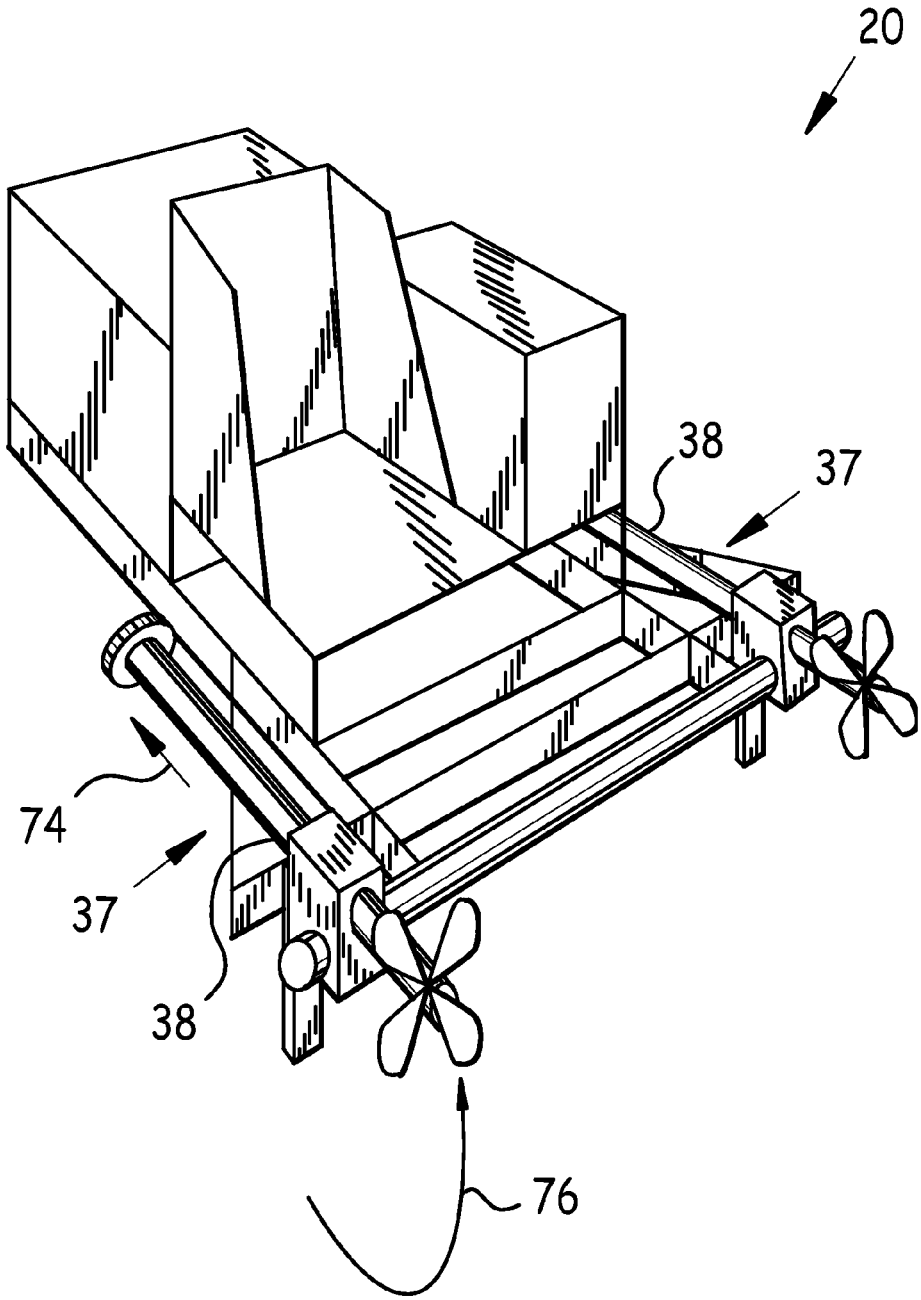
FIG. 7 is a left rear quarter elevated isometric view of an alternate embodiment self-contained hydraulic thruster for vessel having a two lower units offset from the helm platform to permit full retraction and tilting up of the lower units, with the lower units fully retracted and in the tilted-up position.

FIGS. 6 and 7 depict rear quarter isometric views of an alternate embodiment self-contained hydraulic thruster 20 for vessel having two lower units 37 offset from the helm platform 26 to permit full retraction and tilting up of the lower units 37.

As in the embodiment hydraulic thruster 20 depicted in FIGS. 3-5, the hydraulic thruster 20 depicted in FIGS. 6 and 7 comprises power pack 24 mounted to the forward end of base 22, and helm platform 26 mounted to the aft end of base 22. Helm platform 26 is mounted a substantial height above base 22. Helm 28 and hydraulic fluid reservoir 30 are mounted atop helm platform 26.

Hydraulic thruster 20 further comprises two lower units 37 rotatably, tiltably and retractably attached to the rear of hydraulic thruster 20, each laterally offset from helm platform 26, on either side of helm platform 26.

Each lower unit 37 comprises tube 38, housing 32, and propeller 40. Propeller 40 is disposed at a distal end of tube 38, and serves to provide thrust in the water to hydraulic thruster 20. Tube 38 is rotatably and reciprocatingly attached to housing 32, whereby a steering function is provided to tube 38 and propeller 40, as indicated by arrow 73 in FIG. 6, and an extension/retraction function is provided to tube 38 and propeller 40, as indicated by arrow 74 in FIG. 7.

Housing 32 comprises housing lower unit mounting member bore 35 sized to rotatably admit lower unit mounting member 36. Thus, a tilt function is provided to lower unit 37 by means of the rotatable attachment between housing 32 and lower unit mounting member 36.

FIG. 6 is a rear quarter isometric view of this alternate embodiment self-contained hydraulic thruster 20 for vessel having two lower units 37 laterally offset from helm platform 26 to permit full retraction and tilting up of the lower units 37, with the lower units 37 in the extended and tilted-down position.

FIG. 7 is a rear quarter isometric view of this alternate embodiment self-contained hydraulic thruster 20 for vessel having two lower units 37 offset from the helm platform 26, whose lower units 37 have been retracted as indicated by arrow 74 and tilted up as indicated by arrow 76. As may be observed in FIG. 7, the lateral offset of lower units 37 relative to helm platform 26 avoids any interference between lower units 37 and helm platform 26 when lower units 37 are retracted and tilted up.

FIGS. 8-11 depict alternate embodiment self-contained hydraulic thrusters 20 comprising one or more lower units 37 which are tiltably mounted to base 22 at respective pivot points 42, laterally offset from helm platform 26. The alternate embodiments self-contained hydraulic thrusters 20 depicted in FIGS. 8-11 dispense with the lower unit mounting member 36 of FIGS. 3-7. Instead, base 22 comprises pivot points 42 at which each housing 32 is mounted, laterally offset from helm platform 26.

In the embodiments depicted in FIGS. 8-11, each lower unit 37 comprises a propeller 40 at a lower end of a tube 38, a cylinder 44 sized to slidably admit a respective tube 38, and a housing 32 through which a respective cylinder 44 is rigidly attached. Due to the slidable fit between tube 38 and its respective cylinder 44, tube 38 is free to rotate within cylinder 44 (as indicated by arrow 78 in FIG. 8) and reciprocate within cylinder 44 (as indicated by arrow 80 in FIG. 8), thus providing steering function (as indicated by arrow 78 in FIG. 8), and retraction/extension function (as indicated by arrow 80 in FIG. 8), to tube 38 relative to cylinder 44 and housing 32.

Figure 8:
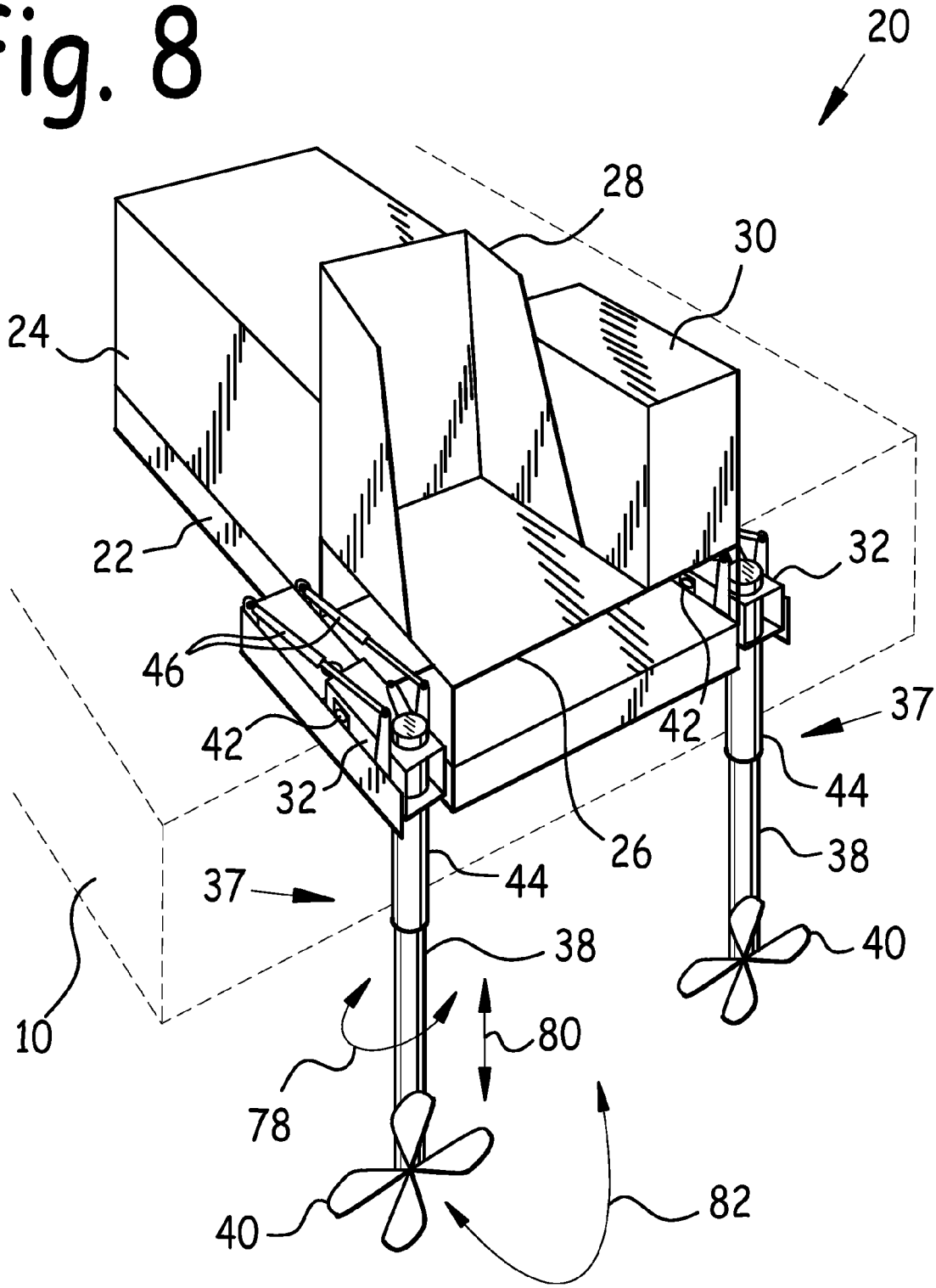
FIG. 8 is a left rear quarter elevated isometric view of an alternate embodiment self-contained hydraulic thruster for vessel having two lower units offset from the helm platform to permit full retraction and tilting up of the lower units, with the lower units in the extended and tilted-down position.

Due to the tiltable attachment between each housing 32 and base 22, each lower unit 37 may be tilted up and down relative to base 22 as indicated by arrow 82 in FIG. 8. As in the steering and retraction functions previously described, any appropriate mechanism may be used to tilt lower unit 37 relative to base 22, including manual actuation. In the embodiments depicted in FIGS. 8-11, lower unit 37 is tilted relative to base 22 by means of actuators 46, which may be hydraulic actuators, linear electric motors, or any other appropriate actuator.

FIG. 8 depicts a rear quarter isometric view of an alternate embodiment self-contained hydraulic thruster 20 for vessel having two lower units 37 laterally offset from helm platform 26 to permit full retraction and tilting up of the lower units 37, with the lower units 37 in the extended and tilted-down position.

FIG. 9 is a side view of this alternate embodiment self-contained hydraulic thruster 20 for vessel having two lower units 37 laterally offset from helm platform 26, with the visible lower unit 37 in the retracted and tilted-down position. As explained previously, FIG. 9 also depicts a cross-sectional view of power pack 24, rendering visible prime mover 50 driving hydraulic pump 52. While FIG. 9 depicts hydraulic pump 52 within power pack 24, it is intended to fall within the scope of this disclosure that hydraulic pump 52 may be disposed anywhere on base 22.

Figure 10:
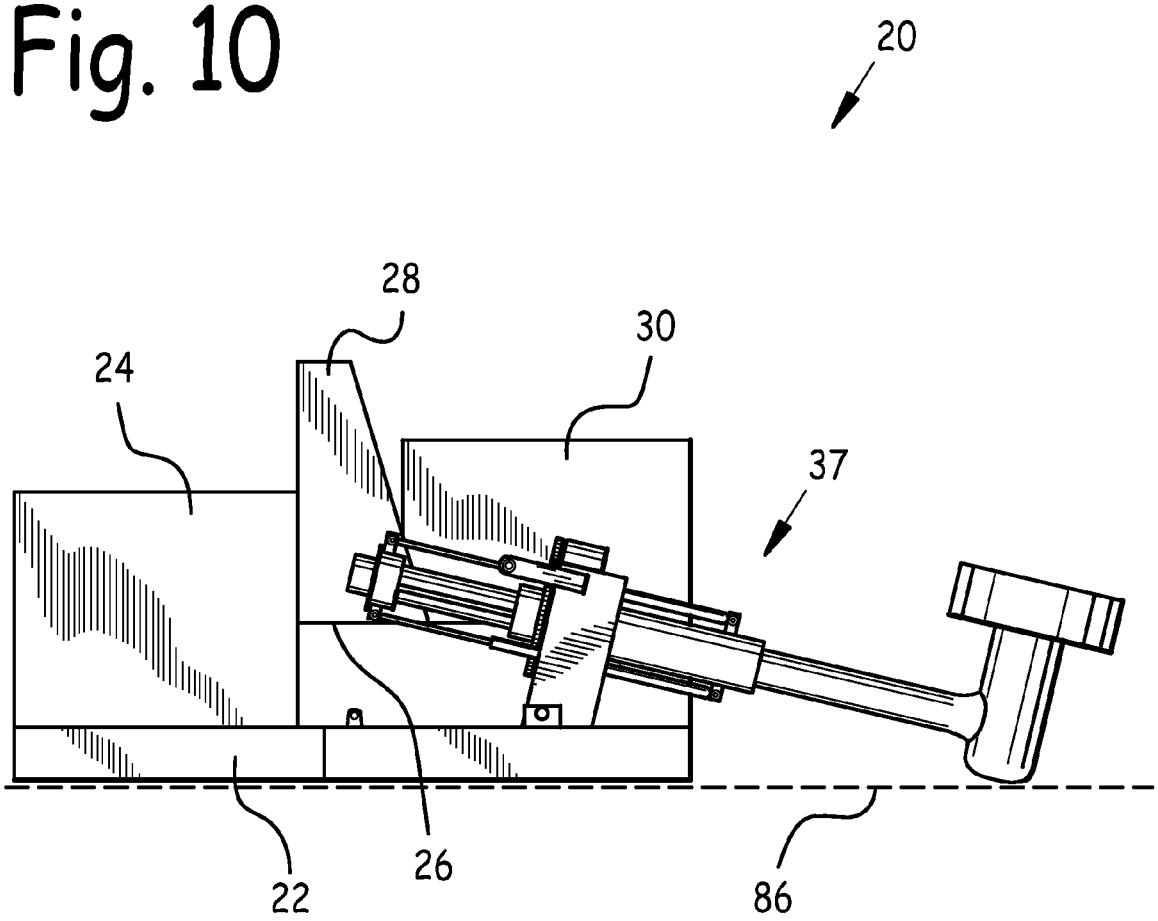
FIG. 10 is a side view of an alternate embodiment self-contained hydraulic thruster for vessel, with the lower units in the fully retracted and tilted-up position for storage, servicing, transportation, cleaning, etc.

FIG. 10 depicts a rear quarter isometric view of an alternate embodiment self-contained hydraulic thruster 20 for vessel having two lower units 20 laterally offset from helm platform 26, with the visible lower unit 37 in the fully retracted and up-tilted position. As may be observed in this view, any interference between lower units 37 and helm platform 26 is avoided by the lateral offset between lower units 37 and helm platform 26.

In all embodiments of the instant invention, prevention of interference between lower unit(s) 37 and helm platform 26 enables lower unit(s) 37 to be fully tilted up for storage, transportation, maintenance, etc., as depicted in FIG. 10. In this configuration (with lower unit(s) 37 fully tilted up), hydraulic thruster 20 can lie flat on a surface 86 such as a flatbed truck, flatbed train car, shipping container, etc., thereby significantly reducing shipping and storage cube required, and greatly simplifying shipping and storing hydraulic thruster 20 by eliminating the need to provide dedicated shipping/storage stands and fixtures.

Figure 11:
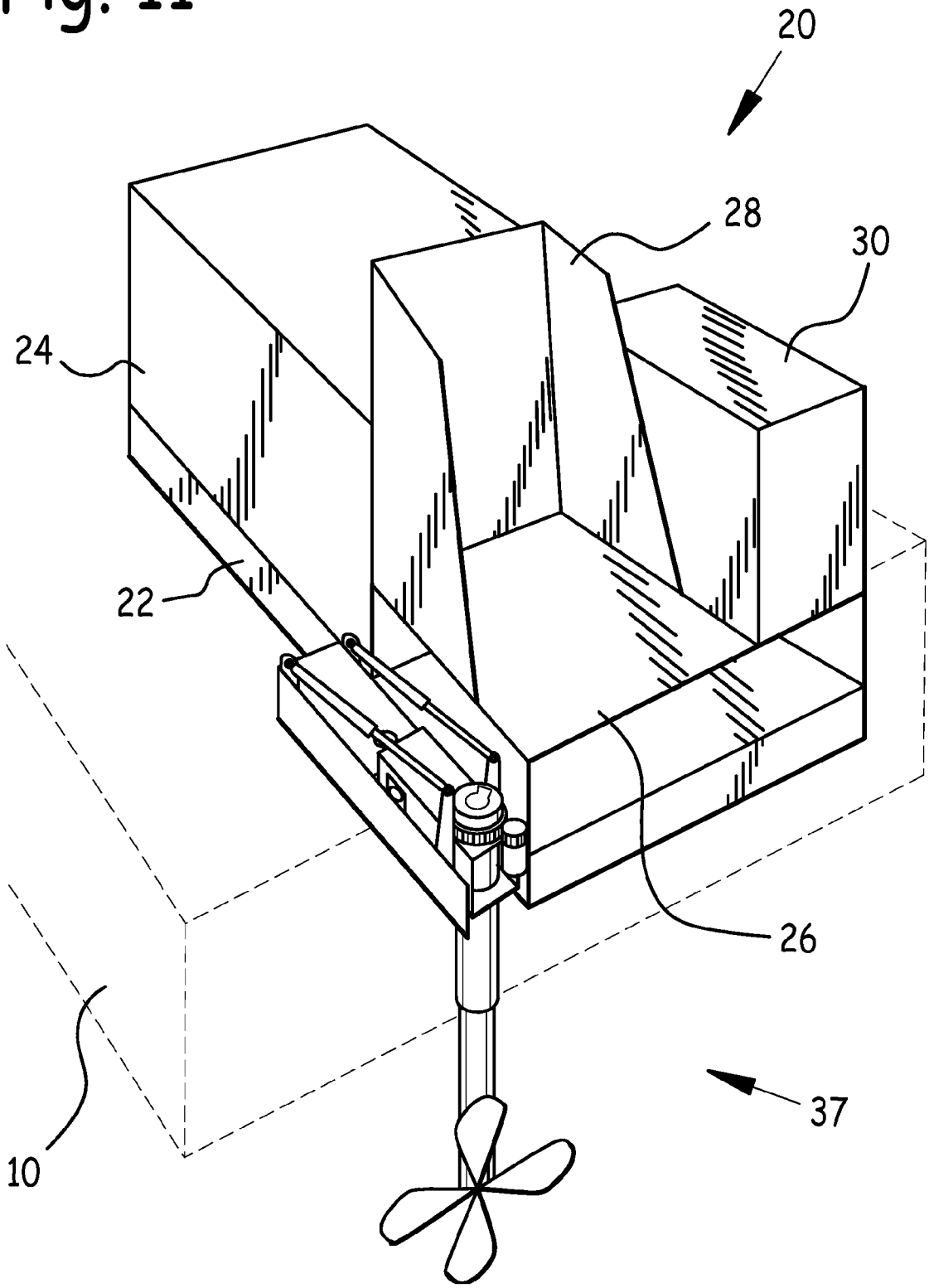
FIG. 11 is a left rear quarter elevated isometric view of an alternate embodiment self-contained hydraulic thruster for vessel having a single lower unit offset from the helm platform to permit full retraction and tilting up of the lower unit, with the lower unit in the extended and tilted-down position.

FIG. 11 is a rear quarter isometric view of an alternate embodiment self-contained hydraulic thruster 20 for vessel having a single lower unit 37 offset from helm platform 26 to permit full retraction and tilting up of the lower unit 37, with lower unit 37 in the extended and tilted-down position. As explained above, any interference between lower unit 37 and helm platform 26 is avoided by the lateral offset between lower unit 37 and helm platform 26.

While the instant disclosure teaches a number of embodiments wherein at least one lower unit is tiltably attached to a base, laterally offset from a helm platform, this disclosure is intended to embrace any means of tiltably attaching a lower unit to a base, laterally offset from a helm platform. Other means of attachment might include hinge(s), a ball-in-socket arrangement, a lower unit tiltably attached to a lower unit mounting tube, attaching the lower drive housing to the end of a boom (e.g. remove the bucket from a track-hoe or a backhoe, attach housing 32 to it and lower it down into the water, like a knuckle boom), etc.

In the preferred embodiment, base 22, helm platform 26, helm 28, hydraulic fluid reservoir 30, lower unit mounting member 36, and lower units 37 were made using metal, synthetic material, corrosion-resistant metal, corrosion-resistant metal fasteners, welded construction, or other appropriate materials and processes. Power pack 24, propeller 40, and actuators 46 were commercially available items.

While a preferred embodiment of the invention has been illustrated herein, it is to be understood that changes and variations may be made by those skilled in the art without departing from the spirit of the appending claims.

DRAWING ITEM INDEX

2 prior art marine thruster
4 prior art lower unit
6 prior art helm
10 vessel
20 hydraulic thruster
22 base
24 power pack
26 helm platform
28 helm
30 hydraulic fluid reservoir
31 hydraulic fluid reservoir floor
32 housing

33 hydraulic fluid reservoir floor height
34 housing tube bore
35 housing lower unit mounting member bore
36 lower unit mounting member
37 lower unit
38 tube
40 propeller
42 pivot point
44 cylinder
46 actuator
50 prime mover
52 hydraulic pump
54 hydraulic pump height
56 hydraulic line
68 arrow
70 arrow
72 arrow
73 arrow
74 arrow
76 arrow
78 arrow
80 arrow
82 arrow
84 surface

I claim:

1. A self-contained hydraulic thruster for vessel comprising:

a helm platform mounted on a base at a substantial height thereabove; a power pack mounted on said base adjacent said helm platform, said base underlying said helm platform and said power pack, said base substantially co-extending with said helm platform and said power pack; and at least one lower unit tiltably attached to an aft end of said base, each said lower unit being mounted to said base laterally offset from said helm platform, whereby interference between said lower unit and said helm platform is avoided when said lower unit is retracted and tilted up.

2. The self-contained hydraulic thruster for vessel of claim 1 wherein each said lower unit comprises a housing, a tube, and a propeller; said propeller being mounted at a distal end of said tube; said tube being rotatably and reciprocatingly attached to said housing; each said housing being tiltably mounted to aft end of said base and laterally offset from said helm platform.

3. The self-contained hydraulic thruster for vessel of claim 2 further comprising a lower unit mounting member attached along an aft edge of said base, each said at least one lower unit being mounted at an end of said lower unit mounting member laterally offset from said helm platform.

4. The self-contained hydraulic thruster for vessel of claim 2 wherein said base further comprises at least one pivot point, each said housing being tiltably attached to said base at a corresponding said pivot point.

5. The self-contained hydraulic thruster for vessel of claim 1 further comprising a hydraulic power pack mounted on said base, and a hydraulic fluid reservoir mounted on said helm platform, whereby said substantial height of said helm platform upon which said hydraulic fluid reservoir is mounted facilities flow of hydraulic fluid from said hydraulic fluid reservoir to said power pack and renders said hydraulic power pack self-priming.

6. The self-contained hydraulic thruster for vessel of claim 5 comprising a prime mover driving a hydraulic fluid pump having a hydraulic fluid pump height, and a hydraulic fluid reservoir floor disposed at a hydraulic fluid reservoir floor height above said base, said hydraulic fluid reservoir floor height being equal to or greater than 75% of said hydraulic fluid pump height.

7. A hydraulic thruster system, comprising:

a helm platform mounted on a base;

at least one lower unit attached at an aft of said base and laterally offset from said helm platform, said helm platform being mounted at a substantial height above said base; and a hydraulic power pack mounted on said base, and a hydraulic fluid reservoir in fluid communication with said power pack mounted on said helm platform, whereby when said lower unit is retracted and tilted up, said lower unit is disposed along a side of said helm platform.

8. The self-contained hydraulic thruster for vessel of claim 7 wherein each said lower unit comprises a housing, a tube, and a propeller; said propeller being mounted at a distal end of said tube; said tube being rotatably and reciprocatingly attached to said housing; each said housing being tiltably mounted to aft end of said base and laterally offset from said helm platform.

9. The self-contained hydraulic thruster for vessel of claim 8 further comprising a helm mounted to said helm platform, said power pack being mounted at a forward end of said base, said helm platform being mounted at an aft end of said base.

10. A self-contained hydraulic thruster for vessel comprising a power pack mounted at a forward end of a base; a helm platform mounted at an aft end of said base at a substantial height above said base; a hydraulic fluid reservoir mounted on said helm platform, said hydraulic fluid reservoir communicating with said power pack; and at least one lower unit tiltably attached at said aft end of said base laterally offset from said helm platform, wherein when said lower unit is retracted and tilted up, interference between said lower unit and said helm platform is avoided.

11. The self-contained hydraulic thruster for vessel of claim 10 wherein each said lower unit comprises a housing, a tube, and a propeller; said propeller being mounted at a distal end of said tube; said tube being rotatably and reciprocatingly attached to said housing; each said housing being tiltably mounted to said aft end of said base and laterally offset from said helm platform.

12. The self-contained hydraulic thruster for vessel of claim 11 comprising two said lower units respectively attached to said aft end of said base on opposite sides of said helm platform and each laterally offset from said helm platform, whereby when said lower units are retracted and tilted up said lower units are disposed along opposite sides of said helm platform.

13. In combination, the self-contained hydraulic thruster for vessel of claim 10 and a vessel, said self-contained hydraulic thruster for vessel base being mounted on an aft end of said vessel.

14. The self-contained hydraulic thruster for vessel of claim 10 comprising a prime mover driving a hydraulic fluid pump having a hydraulic fluid pump height, and a hydraulic fluid reservoir floor disposed at a hydraulic fluid reservoir floor height above said base, said hydraulic fluid reservoir floor height being equal to or greater than 75% of said hydraulic fluid pump height.

* * * * *